US005189236A

United States Patent [19]

Stevens

[11] Patent Number: 5,189,236

[45] Date of Patent: Feb. 23, 1993

[54] TUNABLE RESONATOR PLUG

[76] Inventor: Leigh H. Stevens, 515 8th Ave., Asbury Park, N.J. 07712

[21] Appl. No.: 778,675

[22] Filed: Oct. 18, 1991

[51] Int. Cl.[5] ..... G10D 13/08

[52] U.S. Cl. ..... 84/410; 84/386

[58] Field of Search ..... 84/410, 386, 454, 456

[56] References Cited

U.S. PATENT DOCUMENTS 4,570,525 2/1986 Suzuki ..... 84/410
4,770,080 9/1988 Jivoin ..... 84/386
4,941,386 7/1990 Stevens ..... 84/410

*Primary Examiner*—William M. Shoop, Jr.
*Assistant Examiner*—H. Kim
*Attorney, Agent, or Firm*—Ray F. Cox, Jr.

[57] ABSTRACT

An improved resonator tuning plug for the resonators of keyboard percussion instruments. An inexpensive plug suitable for the entire range of the keyboard instrument, offering quick tuning changes and secure locking of position. A thickness of material shaped to a slip fit within the resonator is slotted on one surface in such a manner that pressure applied to a tapered center hole expands the circumference and produces a pneumatic seal. The tuning plug is invertible so that tonal characteristics of the air column are further adjustable.

5 Claims, 3 Drawing Sheets

TUNABLE RESONATOR PLUG

BACKGROUND OF INVENTION

1. Field of the Invention

The present invention relates generally to keyboard percussion instruments, such as marimbas, vibraphones and xylophones, which have resonators associated with tone bars.

Keyboard percussion instruments are particularly finicky in terms of their tuning and tone quality. They do not just go out of tune, they go out of tune in two different directions at once! In warm temperature and high humidity the tone bars go flat and the resonators go sharp. The opposite condition results in cool dry weather conditions. This adversely effects not only the pitch, as with any musical instrument, but also the tone quality of the instrument. This is because keyboard percussion instruments rely on sympathetic resonance of the resonator tube to the tone bar. If these two vibrating systems are not perfectly in tune, unmusical results are obtained.

Despite these problems with weather and tuning, keyboard percussion instruments are usually sold with non-movable force-fit metal stops in the resonator tubes. These permanent stops are prepositioned at the factory to resonate the above-suspended bar at a particular temperature and humidity level. To insure a perfect pneumatic seal and rigid structure, these oversized metal caps are inserted with a hydraulic press. Looser fitting caps are frequently glued or welded in position.

The position of these plugs is determined not only by the temperature and weather conditions at the point of manufacture, but also the taste of the designer and accidents and inconsistencies of manufacturing. When the instrument is played in an environment that exactly duplicates that for which it was tuned, (usually about 50% humidity and 72° F.), these resonators perform admirably. However, a reduction of the ambient air temperature by as little as 4° F. substantially reduces the volume potential of the instrument while increasing the apparent ring-time of the bar, adversely influencing the tone character of the combined bar/resonator system. Conversely, an increase of 4° F. in the ambient temperature reduces the apparent ring-time of the bar/resonator system to a level that even a lay person can hear easily.

Until recently musicians have generally had to endure these shortcomings in performance. Even if the musician could take along all the wood-working or metal-working equipment to tune the tone bars at the performance site, this would not be a viable method to compensate for transitory weather conditions: tuning the tone bar requires removing material from the bar. No more than a few tunings can be performed before permanent loss of mass begins to be audible as loss of tone quality. Thus, the only way to bring these two sympathetically-vibrating systems into musical resonance is to change the effective length of the resonator tube.

In spite of great efforts expended by musical instrument manufacturers, finding an inexpensive and effective method by which the musician can quickly alter the pitch of resonator pipes, has been elusive. There is an inherent conflict in the function of a tunable stop; to produce the best musical tone, the stop needs to be air-tight, rigid and it should not camber away from a 90° relationship to the wall of the resonator. Even when the seal is airtight, volume is greatly reduced and an unfocused tone is produced unless the seal is at the uppermost leading edge of the plug. To be useful for the musician, the plug must be quick to adjust over a one inch range and conveniently designed so that the player can hear the results while tuning. In summary, the problem musical instrument designers have encountered is that the easier the plug is to adjust, the less airtight and rigid the plug is. Thus, the sound is likely to be less musically satisfying. Last but most important, the design must be inexpensive enough to manufacture so that it they can be provided on all resonators of keyboard percussion instruments, not just the bottom few notes.

2. Description of the Prior Art

To those not skilled in the art of keyboard percussion instrument construction, a simple slide fit comes to mind as a possible solution to the above problems, but in actual practice, slight deformations of the roundness of resonators prevents a slide fit plug from producing a musically-useful result. For slightly different reasons traditionally-designed expansion plugs do not produce satisfactory results in musical instruments. These plugs usually have a top and bottom rigid plate-like structure with a soft, compressible intermediate layer between. Applying pressure on the two outer plates squeezes out the intermediate sealing layer. Not only does this seal the resonator at a point somewhat below the level of the leading edge, its inherent design allows the plug to camber when pressure is reduced. These two shortcomings produce an unfocused sound and reduce volume and richness of the tone character. For similar reasons O-ring plugs have not been successful: the seal is below the leading edge of the plug where the antinode of the vibrating column of air resides; cambering is common even when two O-rings are used per plug. Adjustability is reduced if the fit is tight enough to produce a rigid pneumatic seal.

In recent years the two largest manufacturers of keyboard percussion instruments in the world have introduced patented tunable resonators into their line of professional instruments. U.S. Pat. No. 4,570,525 assigned to Suzuki/Yamaha provides for 'C' shaped expansion rings to provide radial expansion of a slotted cap against a tubular gasket. The 'C' shaped expansion ring does not provide equal radial expansion for proper sealing against the entire circumference of the inside wall of the resonator. This reduces the maximum volume of this plug design. Further, the cost of manufacturing this system has limited its use to the bottom few notes of the most expensive instruments offered by this manufacturer.

In the present inventor's U.S. Pat. No. 4,941,386 a threaded cap assembly shortens and lengthens the effective length of the tube. This design has also proven to be very expensive to manufacture and as a result is only offered on the bottom twelve notes of the most expensive marimba offered by the assignee, The Selmer Company's Musser Division. Another shortcoming of this design is the speed of adjustment. The necessity of having thin-walled assembly introduced into the bottom of the tube so as to not adversely effect the tone of the resonator, limits the coarseness of the lead of the threads to about 20 per inch. This factor, along with the impingement of adjacent tubes and the anti-vibration fingers pressing on the cap, prevent the musician from turning the cap more than a ¼ turn at a time. Thus, a one inch change of length on one resonator can require as many as 80 hand motions to accomplish. The present invention overcomes the above problems of cost, convenience and acoustics.

SUMMARY OF THE INVENTION

The present invention provides an inexpensive tunable resonator plug for the resonators of keyboard percussion instruments. A sheet of machinable or moldable material such as metal or plastic is shaped to a slip fit size within the resonator to be tuned. One surface is relieved with one or more slots part of the way through the plug, radiating from a central hole which is drilled part way through the plug. In the preferred embodiment the hole is tapped. Depending on the performance characteristics desired, the slits may or may not be filled with common silicone or gasket material. A means of applying outward pressure on the circumference of the hole, such as a threaded machine screw with a tapered shoulder, is introduced into the hole. When the screw or other pressing means is applied, the sheet deforms, expanding the circumference on the filleted side and sealing itself against the inside wall of the resonator. The plug is reversible in that different musical results can be achieved with either the filleted side or the smooth side facing the air column.

DETAILED DESCRIPTION OF THE PREFERRED EMBODIMENTS

For the following discussion it will be assumed that round tubular resonators are being used. Square, rectangular, oval and flaring shapes are also in use and the present invention can easily be modified for those resonator shapes.

Figure 1:
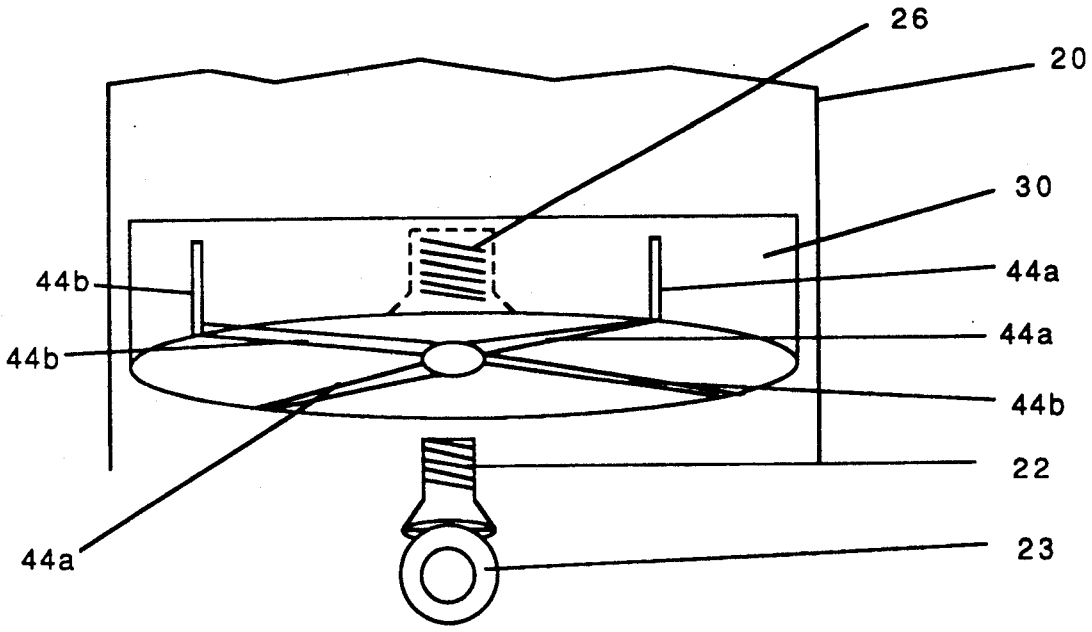
FIG. 1 is a perspective a view from below of the resonator plug in a resonator tube with the slotted face of the plug down.

With reference to FIG. 1, a disk 30 of solid material is turned, molded or otherwise shaped to a size that fits within the inside diameter of the resonator tube 20 to be tuned. The diameter of the disk 30 may be chosen to produce a mechanical slip fit inside the resonator tube 30. The thickness of the disk 30 may be chosen to eliminate camber even when expansion is at minimum.

Figure 3:
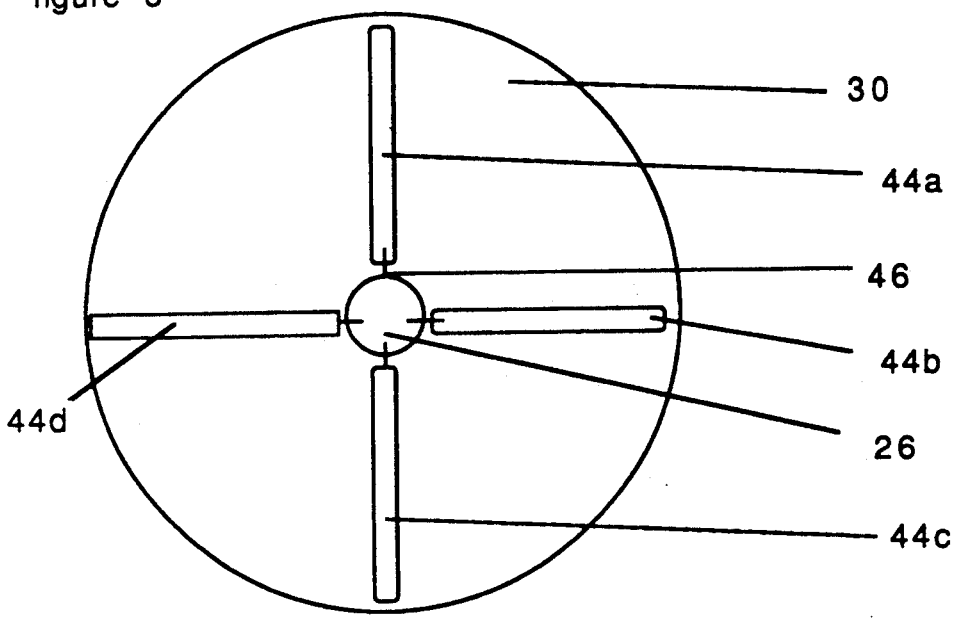
FIG. 3 is a top view of another embodiment of the invention with milled slots replacing saw cuts.

In one of the embodiments of the invention the center of one of the faces of the disk 30 is drilled part of the way through to the other face and tapped. The disk 30 is then saw cut or milled, breaking through the threads on the outer circumference of the tapped wall of the center hole 26. These slots 44*a* and 44*b* may be created in a variety of ways. In one embodiment one or more simple band saw cuts are made into and across the face of the disk 30. Said saw cuts may extend any depth into the disk 30. The greater the depth, the greater the potential expansion. Referring to FIG. 3, if sufficient relief is provided by milling the slots 44*a, b, c* and *d*, it may not be necessary to break through the outer circumference of the disk 30. This depends on the amount of expansion desired and the flexibility of the material chosen for the disk 30.

A tapered shoulder bolt 22 is introduced into the center hole 26. Gripping means 23 allows the tapered shoulder bolt 26 to expand the disk 30 so that firm contact is made with the walls of the resonator tube 20.

It is axiomatic that the closer the initial fit of the disk 30 to the resonator tube 20, the less expansion needed for a pneumatic seal. With very inflexible materials such as aluminum, expansions of the diameter of the disk 30 by 7/1000 inch have been achieved with patterns of saw cuts. With semi-flexible plastics such as polyethylene, expansions of 60/1000 inch have been achieved with only two X shaped saw-width relief cuts. Since tolerances of only a few thousands of an inch are customary on a slip-fit lathe cut or molded part, it can be seen that the choice of materials for the resonator plug can be made strictly on the basis of cost and acoustic results, not functionality of the design.

If cutting or machining of the slots 44*a* and 44*b* across the diameter of the disk 30 have been made in such a way as to break though the outer circumference of the disk 30 the slots 44*a* and 44*b* may be filled with common silicone, caulking compound or gasket material to eliminate any possible air leak at the cut points. The desirability of filling the slots 44*a* and 44*b* appears to depend on the tone character desired and the flexibility of the material employed for the plate. Stiff materials such as aluminum suffer from pin hole sized air leaks where the saw cut pierces the outer wall of the disk 30, unless the slots 44*a* and 44*b* are filled with sealant. Flexible materials such as rubber, polyethylene and polyurethane appear to provide adequate seals and sufficient volume projection of the tone bar without backfilling the slots 44*a* and 44*b*. Such backfilling is a necessity when the resonator plug is used upside down, as described later.

Tuning of the resonator is achieved by loosening the tapered shoulder bolt 22 just enough to return to a slip fit. The resonator plug is then slid up or down the resonator tube 20 as weather conditions require. When the most desirable position is found, according to the musician's personal taste, the tapered shoulder bolt 22 is retightened to expand the circumference of the disk 30 to seal off any air leaks. In one embodiment of the present invention actually manufactured and operating, a tapered shoulder bolt 22 with a lead of 1/13 of an inch per revolution has been used. This course thread appears to produce a perfect seal with as little as ½ of one turn of the tapered shoulder bolt 22. Thus, it has been found that a change of resonator plug position of as little as 1/64 of an inch, or as much as 1 or 2 inches can be accomplished in less than 3 seconds. This is a dramatic improvement over earlier designs.

It is a surprising result of this design that it is hard to make this plug sound "bad". Most movable plugs have only one "sweet" spot, and all other positions below the proper pitch produce weak tones and all positions above the proper pitch produce short tones. For reasons I am not yet able to explain, the range of acceptable positions for this design is very wide. It is impossible to make the bar ring short by positioning the resonator plug too high. When the resonator plug is tuned too sharp to the bar, the ring time actually increases, though volume decreases.

Figure 2:
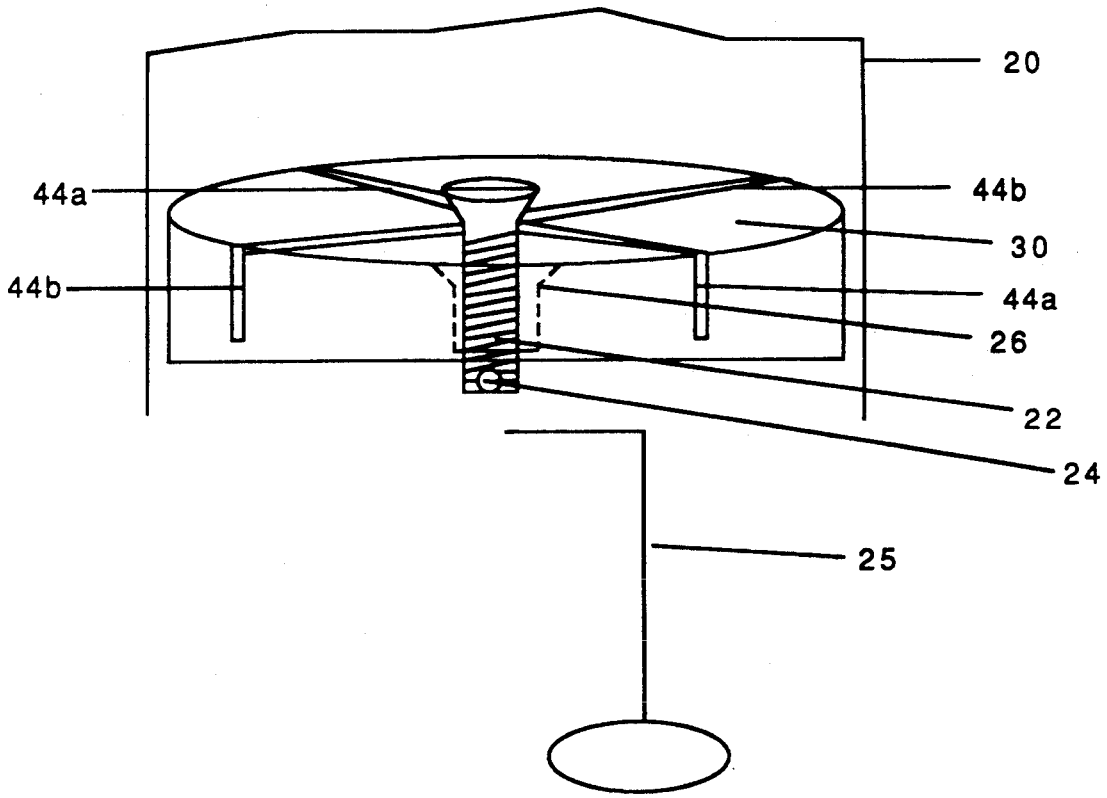
FIG. 2 is a perspective view from above of the resonator plug in a resonator tube with the slotted face of the plug up.

Another unusual aspect of this design is that it produces useful but very different musical results upside down. The original design was intended to be used with the unbroken face of the disk 30 facing the air column. This followed the conventional wisdom that nothing should interfere with the smooth flow of air in the column. It has been found however, that the resonator plug produces surprising results when used with the slots 44*a* and 44*b* facing the air column. In this position a more aggressive tone, resembling a saw-toothed wave form is produced. Thus, with a slight modification, this invention can offer the musician a choice of performance characteristics beyond the tuning of the resonator for weather conditions. In this alternative embodiment the center hole 26 would be drilled and threaded all the way through the disk 30. Turning of the tapered shoulder bolt 22 could be achieved in many ways from the opposite side of the disk 30. In one embodiment the musician would be supplied with a simple tool 25 that would pass through a receptacle 24 in the end of the tapered shoulder bolt 22 as in FIG. 2.

Having read the foregoing, one skilled in the art will readily understand the structure and operation of the present invention. The foregoing description, however, while setting forth the best mode presently contemplated by the inventor for making the present invention, should be considered illustrative and not restrictive in nature. It is intended that modifications and variations of the above-described invention that fall within the spirit thereof shall be covered by the following claims.

I claim:

1. A expansion plug comprised of:

a. a disk formed to the shape of the inside dimension of a tube to be sealed, said disk having an outer circumference with an outer dimension slightly less than the inside dimension of said tube and comprising material capable of elastic expansion;

b. a tapped center hole in said disk;

c. one or more relief cuts across the face of said disk radiating from said hole and penetrating said face of said disk to a depth less than the thickness of said disk such that strain induced in said disk by radial expansion of said hole is dissipated; and d. means for applying outward radial pressure to the circumference of said hole such that said disk is elastically expanded radially to sealably conform to said inside dimension of said tube.

2. An expansion plug as set forth in claim 1 in which one or more of said relief cuts penetrate the outer circumference of said disk.

3. An expansion plug as set forth in claim 2 further comprising flexible sealants applied into said relief cuts.

4. An expansion plug as set forth in claim 3 in which said means for applying outward radial pressure comprises a threaded bolt with a tapered shoulder introduced into said tapped center hole supplying radial expansion to said disk by pressure of said shoulder as it is threadedly received into said tapped center hole.

5. An expansion plug as set forth in claim 4 wherein said tapered shoulder bolt passes through said disk and further comprises means for gripping said tapered shoulder bolt such that said bolt may be turned from the end opposite to the tapered shoulder.

* * * * *